US005562437A

United States Patent [19]

Gauthier et al.

[11] Patent Number: 5,562,437

[45] Date of Patent: Oct. 8, 1996

[54] LIQUID OR GASEOUS FUEL BURNER WITH VERY LOW EMISSION OF NITROGEN OXIDES

[75] Inventors: Jean-Claude Gauthier, Marseille; Frederic Bury, Allauch, both of France

[73] Assignee: Enterprise Generale de Chauffage Industriel Pillard (Societe Anonyme), Marseille, France

[21] Appl. No.: 263,037

[22] Filed: Jun. 21, 1994

[30] Foreign Application Priority Data

Jun. 22, 1993 [FR] France ..... 93/07863

[51] Int. Cl.[6] ..... F23D 14/24

[52] U.S. Cl. ..... 431/10; 431/164; 431/187; 431/351; 431/350

[58] Field of Search ..... 431/10, 187, 164, 431/165, 166, 167, 351, 350

[56] References Cited

U.S. PATENT DOCUMENTS

| | | | |
|---|---|---|---|
| 2,500,787 | 3/1950 | Lelgemann | 431/187 X |
| 3,775,039 | 11/1973 | Pillard | 431/183 X |
| 4,050,879 | 9/1977 | Takahashi et al. | 431/183 X |
| 4,303,386 | 12/1981 | Voorheis et al. | 431/183 X |
| 4,351,632 | 9/1982 | Nagai | 431/351 X |
| 4,842,509 | 6/1989 | Hasenack | 431/10 |
| 4,925,387 | 5/1990 | Locanetto et al. | 431/187 |
| 5,242,296 | 9/1993 | Tuson et al. | 431/10 |

FOREIGN PATENT DOCUMENTS

| | | | |
|---|---|---|---|
| 0124146 | 3/1984 | European Pat. Off. . | |
| 0214003 | 3/1986 | European Pat. Off. . | |
| 0187441 | 7/1986 | European Pat. Off. . | |
| 2450998 | 2/1980 | France . | |
| 2503836 | 10/1982 | France . | |
| 2656676 | 12/1989 | France . | |
| 0123737 | 9/1979 | Japan | 431/10 |
| 0078208 | 5/1985 | Japan | 431/10 |

*Primary Examiner*—Carl D. Price
*Attorney, Agent, or Firm*—Dvorak and Traub

[57] ABSTRACT

The present invention relates to a fluid fuel burner with very low emission of nitrogen oxides, comprising, in known manner, means for injecting the fuel into a hearth at least one primary air supply conduit around said injection means, and at least one secondary air supply conduit located radially on the periphery outside the primary air supply conduit. According to the invention, said injection means comprise multiple orifices creating a plurality of independent divergent flames in the hearth, and the burner comprises as many secondary air supply injectors as there are said flames, each of said injectors being placed axially and angularly with respect to one of these flames, in a position such that it furnishes thereto an additional air fluid after a first phase of combustion.

19 Claims, 3 Drawing Sheets

LIQUID OR GASEOUS FUEL BURNER WITH VERY LOW EMISSION OF NITROGEN OXIDES

FIELD OF THE INVENTION

The present invention relates to a fluid, i.e. liquid or gaseous, fuel burner with very low emission of nitrogen oxides, as well as to a process for exploiting such a burner.

The principal application of the invention is its use in a parallel flow burner comprising an injector with auxiliary fluid atomization presenting a number n of orifices and of sufficiently small outlet relatively to their angle for the burner to generate n flames separated over the whole of its range of operation.

BACKGROUND OF THE INVENTION

Such a burner is the subject matter of a Patent Application No. FR-2 656 676 published on 5 Jul. 1991 and filed jointly by IFP (INSTITUT FRANCAIS DU PETROLE) and the firm PILLARD EGCI: the burner described in this Patent Application effectively makes it possible to reduce the formation of nitrogen oxides (NOX), thanks in particular and in combination with a "rose" stabilizer with blades about a central hub, to the creation of a plurality of independent flames: these latter are described as one of the characteristics of the invention, although multi-flame burners were already known, such as in Application FR 2 503 836 published on 15 Oct. 1982, where a stepped combustion is effected, as a quantity of air passes between the adjacent jets of fuel and thus penetrates further in the zone of combustion before meeting the fuel.

However, the difficulty inherent in this arrangement consists in maintaining a combustion of good quality, i.e. without non-burned residues, as, if the effect of stepping allowing the reduction of nitrogen oxide is accentuated with a reduced number of elementary flames, the final mixture of the air and fuel is more difficult and a part of the air may attain the outlet of the hearth without having participated in combustion, in that case creating non-burned residues; to avoid this, it is possible to increase the excess air supplying the burner, but in that case there are other drawbacks, such as the reduction in output and the increase of the free oxygen in the hearth, which causes the formation of nitrogen oxide to rise and is therefore contrary to the purpose aimed at.

Another process of stepping the air is also known, used in particular in boilers of thermal stations, operating essentially with pulverized coal since the 1970's, and which consist in sending only a part of the combustion air into the burner so as to create a primary combustion zone with excess of fuel, therefore with a low free oxygen content and a slight formation of nitrogen oxide; the remains of the air are introduced in the hearth in the form of so-called secondary air, either via an annular ring around the burner, or via the orifices made in the walls of the hearth at a more or less great distance from the burner; this complementary air is supposed to create a secondary combustion zone making it possible to burn all the fuel.

Such a process and device are described in Patent Application No. FR 2 450 998 of the firm ST. EINMULLER GmbH, filed under German priority and published on 3 Oct. 1980, entitled "Process for reducing the emission of NOX at the outlet of a burner".

The drawbacks of such a process are also the difficulty in obtaining a good air and fuel mixture in the so-called secondary zone, which has for a consequence considerably to increase the length of the flames and to increase the quantity of non-burned residues.

This Patent Application No. FR 2 450 998 specifies the reactional mechanisms provoking the formation of nitrogen oxide in industrial furnaces and of which the reduction of the emission is the object of the two Patent Applications mentioned previously, and of those cited hereinafter, as well as of the present invention.

In fact, it is recalled that this nitrogen oxide is due essentially to two different origins, namely:

- the formation of NOX based on the oxidation of nitrogen in the combustion air itself, which can only be effected with the existence of atomic oxygen or other aggressive radicals, such as OH or $O_3$, as well as with a very high temperature in the combustion chamber, hence a first notion of thermic NOX,
- the formation of NOX from the oxidation of nitrogenous compounds existing in the fuel; during pyrolysis within the flame, there are formed from these compounds nitrogen and carbon or nitrogen and hydrogen radicals, which are oxidized into NOX in the presence of oxygen, due to the reactivity to this gas, even at relatively low temperatures, hence a second notion of fuel NOX.

Taking this double possibility of formation into account, it is known to be necessary, on the one hand, to reduce in the flames the content of free oxygen which risks combining with the nitrogen of the fuel and, on the other hand, to step this combustion in order to reduce the peak temperatures and to increase the rate of burned gas recycled in the flame.

As a function of these considerations, and in addition to the two Patent Applications mentioned hereinabove and describing two types of solutions for attaining this object, other manufacturers have developed particular techniques, of which certain have also formed the subject matter of Patent Applications, such as:

- Application EP 377 233 published on 11 Jul. 1990, filed by the Dutch firm REMEHA FABRIEKEN and entitled "Atmospheric gas burner with low NOX rate", and comprising flat elements extending parallel on the two sides of said flames of the burners;
- or European Application EP 280 568 published on 31 Aug. 1988 and filed by the firm BABCOCK-HITASHI KABUSHIKI KAISHA under Japanese priority and entitled "Combustion apparatus with low NOX concentration", and comprising pipes for distributing pulverized coal, secondary air and tertiary air, as well as gas-distributing pipes disposed in mobile manner.

Other Applications may also be mentioned, each relating to a specific type of fuel and different particular devices for injection and combustion of said fuel, in order to obtain the object sought after; this latter is effectively attained in the majority of cases, but, with limits since, as indicated hereinabove, when the rate of nitrogen oxide is reduced by one of the means described in the Patent Applications mentioned above, too much, a drop in output is often created, and poor combustion, in that case creating non-burned residues. Moreover, each fuel has inherent combustion characteristics and the devices most adapted to one type of fuel generally cannot be transposed on another, and sometimes even the contrary.

The problem raised is therefore that of being able to produce a burner essentially with fluid, i.e. liquid or gaseous, fuel, from any known, for example axial supply burner device, but of which it is desired to reduce to a very low level the emission of nitrogen oxide, without, however, reducing the power thereof, nor increasing the non-burned exhaust gases.

One solution to the problem raised is a process for exploiting a known fluid fuel burner comprising means for injecting the fuel into a hearth , at least one conduit for supplying primary air and a flame stabilizer around said injection means and at least one conduit for supplying secondary air located radially on the periphery outside the primary air supply conduit, in which:

said fuel is injected in several divergent directions in the hearth to create independent flames therein;

said secondary air is injected by as many injectors as there are independent flames, each of said secondary air injections being effected axially and angularly with respect to each of the flames depending on a position of said injectors, such that the additional air flux is brought after a first combustion phase.

SUMMARY OF THE INVENTION

Another solution to the problem raised is the production of a fluid fuel burner comprising, as before and in known manner, means for injecting the fuel in a hearth, at least one primary air supply conduit and a flame stabilizer around said injection means, and at least one secondary air supply conduit, located radially on the periphery outside the primary air supply conduit; according to the invention, said injection means comprise multiple orifices creating a plurality of independent, divergent flames in the hearth; and the burner comprises as many secondary air supply injectors as there are said flames, each of said injectors being placed axially and angularly with respect to one of these flames, in a position such that it supplies an additional air flux thereto after a first combustion phase.

In a preferred embodiment, said central primary air stabilizer, disposed around the fuel injection means, comprises inclined blades about a central hub connecting it to said fuel injection means.

The result is a novel process for exploiting burners and novel fluid, i.e. liquid or gaseous, fuel burners, with very low emission of nitrogen oxide, which respond to the problem raised by improving the performances of the heretofore existing burner devices, yet having, for certain, the same object of reducing the emission of nitrogen oxide.

In fact, the present invention proposes devices which make it possible to accumulate to a minimum the advantages of the two processes and corresponding burners as presented in the preamble, and of which one example is described in Patent Application FR 2 656 676 and the other in Patent Application FR 2 450 998: in fact, the individual performances of each of these processes in the reduction of the nitrogen oxides are improved, whilst maintaining a combustion of good quality.

In fact, thanks to separate and judiciously placed air generators according to the invention and which no document, Patent nor embodiment known at the present time describes nor evokes in combination with separate flames, complementary combustion air is supplied to the precise places where it is necessary to have a complete combustion of the end of the separate elementary flames; this combination of generators and of flames, associated and separate, on the one hand allows a stepped combustion, as already indicated hereinbefore, and, on the other hand, limits their peak temperature, thanks to a high rate of recirculation of the gases resulting from the combustion in these different flames.

The secondary air injectors are in a number equal to that of the elementary flames and are preferably, when the burner comprises a central stabilizer comprising inclined blades, angularly offset with respect to the jets of fuels in order to take into account the curve of these latter induced by the primary combustion air then set in rotation by the flame stabilizer.

They are also positioned radially and axially to furnish an air flux supplying each elementary flame over the whole of its width, at the moment when the mixture begins to lack air due to the development of combustion.

Such a device makes it possible to reduce the number of elementary flames, which are preferably, at the present time, of the order of 7 or 6, 5 or even 4, and therefore to improve reduction of formation of NOX whilst conserving a good combustion. It also makes it possible, by reducing the quantity of primary air in the burner, to reduce the quantity of free oxygen present in the first part of each elementary flame, and therefore also the formation of the nitrogen oxides, allowing full benefit of the effect of stepping of the air.

Moreover, the secondary air thus injected according to the invention in the flame tail and allowing a secondary combustion, the latter is produced in a medium considerably diluted by the gases coming from the recirculation of the fumes by the combustion products of the primary zone: this secondary zone is therefore also with reduced oxygen content at low temperature, therefore with limited formation of nitrogen oxide as indicated hereinabove.

Tests on devices according to the invention and from existing devices have shown an additional reduction of 30 to 40% of the emissions of NOX with respect to a burner with separate elementary flames, but the invention may be applied to other types of multi-flame burners, such as for example the one described in Patent Application FR 2 656 676: the total reduction of the emissions of NOX with respect to a conventional flame with nitrogenous liquid fuels, may be considered to be of the order of 50% or more, the preceding arrangements being particularly favourable to the reduction of the NO fuel.

Furthermore, in the devices of divergent multi-flame type existing at the present time, the total diameter of the furnace necessary for the same power with respect to a mono-flame, is of the order of at least 50% more than the latter: in fact, the elementary flames created form a divergent angle with respect to the axis of the burner of 30 and 60° in order to obtain, for the purpose of stepping the combustion indicated hereinabove, a deviation of the air and the fuel by deviating the direction of the flame with respect to the arrival of the air, but the obtaining of such a diameter limits the application thereof to hearths of sufficient transverse dimensions.

Thanks to the present invention, an additional advantage of the burner according to it is to allow an aerodynamic action on the elementary flames by means of the impulsion of the secondary air jets on the periphery thereof, as this action reduces the inclination of the ends of the flames with respect to the general axis of the hearth and more reduced diametral dimensions are thus obtained allowing the installation of the burner in hearths of small transverse dimensions.

Other advantages of the present invention may be mentioned, but those cited hereinabove already sufficiently demonstrate the novelty and interest thereof.

BRIEF DESCRIPTION OF THE DRAWINGS

The invention will be more readily understood on reading the following description with reference to the accompanying drawings, in which.

DESCRIPTION OF PREFERRED EMBODIMENT

Figure 1:
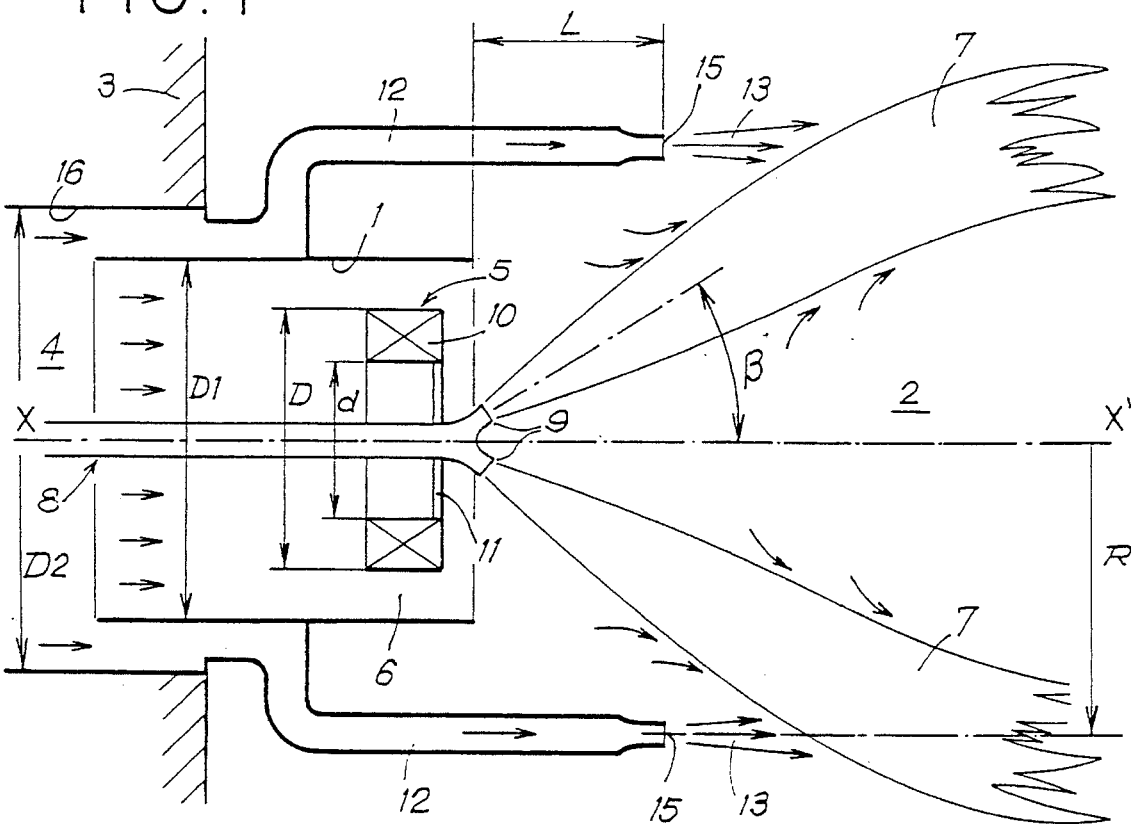
FIG. 1 is a simplified view in section of an embodiment of burner according to the invention.

Referring now to the drawings, FIG. 1 firstly shows a liquid fuel burner comprising, in known manner, means 8 for injecting the fuel in a hearth 2, at least one primary air supply conduit 4 and a flame stabilizer 5 around said injection means 8 and at least one secondary air supply conduit 12 located radially on the periphery outside the primary air supply conduit 4; in the heretofore known devices, this secondary air supply is brought in a ring continuously, or discontinuously, but uniformly distributed about a single flame and the arrival of the central primary air.

In the present invention, said fuel injection means 8 comprise multiple orifices 9 creating a plurality of independent, divergent flames 7 in the hearth 2 and the burner comprises as many injectors 15 for supplying secondary air 12 as there are said flames 7, each of said injectors 15 being placed axially and angularly with respect to one of these flames 7 in a position such that it supplies thereto an additional air flux after the first phase of combustion occurring between the outlet of the fuel via the orifices 9 and the point of contact between the separate flames and the additional air issuing from these injectors 15; this position is defined for each injector 15 by its radial distance R to axis xx', its axial distance L with respect to the orifices 9 and its angular deviation $\gamma$ in the plane perpendicular to the axis xx': these three coordinates are defined hereinafter and are dependent on the angles $\beta$ of inclined projection of each flame 7 associated with the length thereof as a function of the power and of their own angles of deviation.

In fact, in order to obtain the maximum effect of the independent flames 7, the central primary air stabilizer 5, disposed around the fuel injection means 8, preferably comprises inclined blades 10 around a central hub 11 connecting it to said injection means 8. In other embodiments, this stabilizer may be of any shape known to ensure the desired effect, such as a cone.

Figure 7:
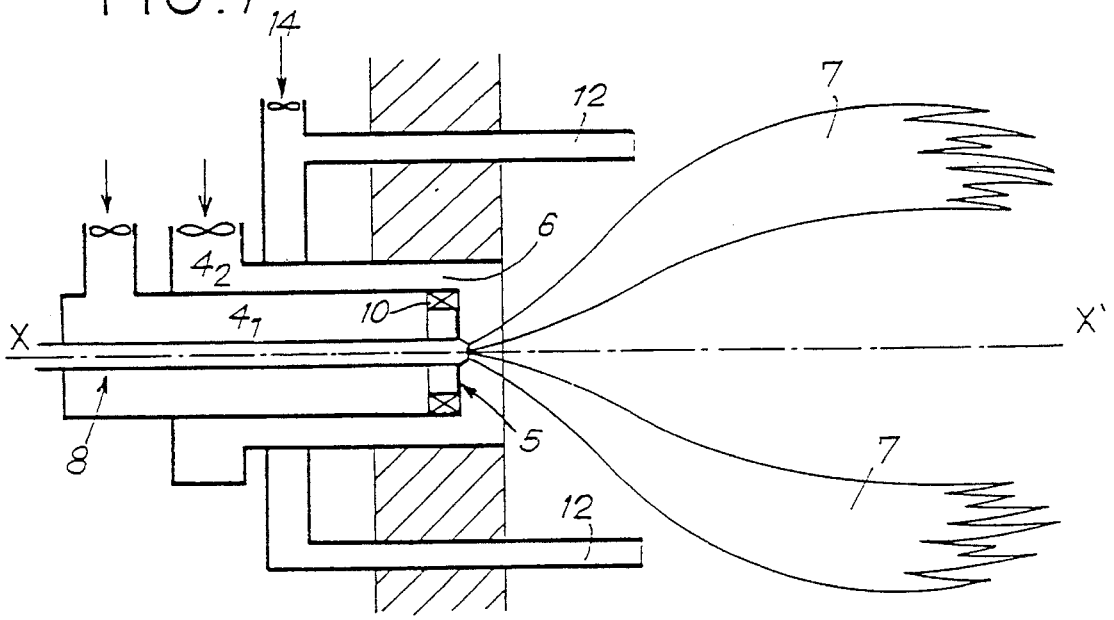

This central hub 11 supports said flame stabilizer 5 when there is only one conduit 1 for supplying the air necessary for combustion, but, in other embodiments such as in particular the one of FIG. 7, said stabilizer 5 may be borne by one of the primary air supply conduits, other peripheral conduits 6 being able to complete this primary air or supply additional secondary air.

Said central hub may be partly conical or totally flat and may comprise slots for cooling the injector 8 and injector orifices or heads 9.

Its outer diameter "d" corresponds to the inner diameter of the stabilizer 5, of which the outer diameter "D" is itself smaller than the inner diameter D1 of the principal primary air supply conduit 1, as shown in the embodiment of this FIG. 1.

The general supply conduit 16 passes through the wall of the boiler 3 defining the hearth 2 and may bear at its end inside the hearth all the air conduits and injectors, in that case supplied from one source of air supply 4.

The multiple fuel-injection orifices 9 make angles $\beta$ with the axis xx' of the burner, preferably included between 30 and 60°, these angles possibly being different from one orifice to the other in order to occupy more volume of the cone thus formed, and better differentiate the flames independently of one another.

Figure 2:
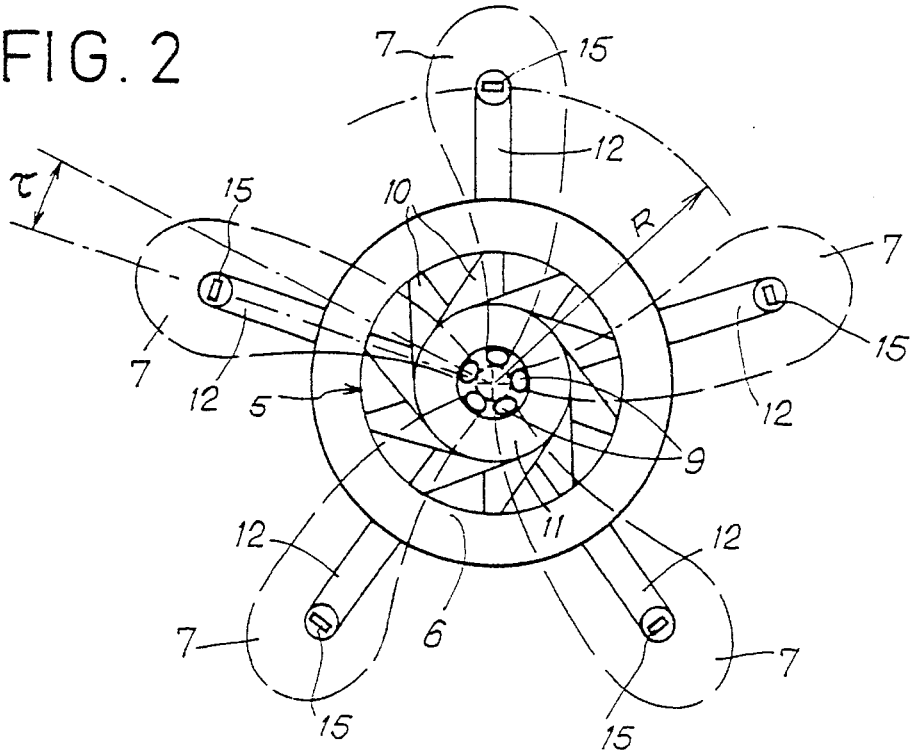
FIG. 2 is a front view of the burner of FIG. 1.

FIG. 2 shows such a burner in axial view projecting five independent flames with angles $\gamma$ of deviation with respect to the planes defined by the injectors 9 from which they issue and the principal axis xx': the positions of the ends of the secondary air injectors 15 with respect to the axis xx' of the burner are here located on the same circle of radius R, the angle $\beta$ of projection being the same for the five flames and are offset angularly with respect to the jets of fuels by the same angle $\gamma$, due to the inclination of the blades 10 of the stabilizer 5.

The secondary air thus supplied via these peripheral injectors 15 represents, according to the invention, between 20 and 50% of the total air supplied in the hearth 2 for combustion and, preferably, this percentage is about 35% of the total air; the respective and equal number of fuel injectors 9 and therefore of secondary air injectors 15 associated with each corresponding flame 7 is preferably taken as being more than or equal to 4 and at the most equal to 7.

Figure 3:
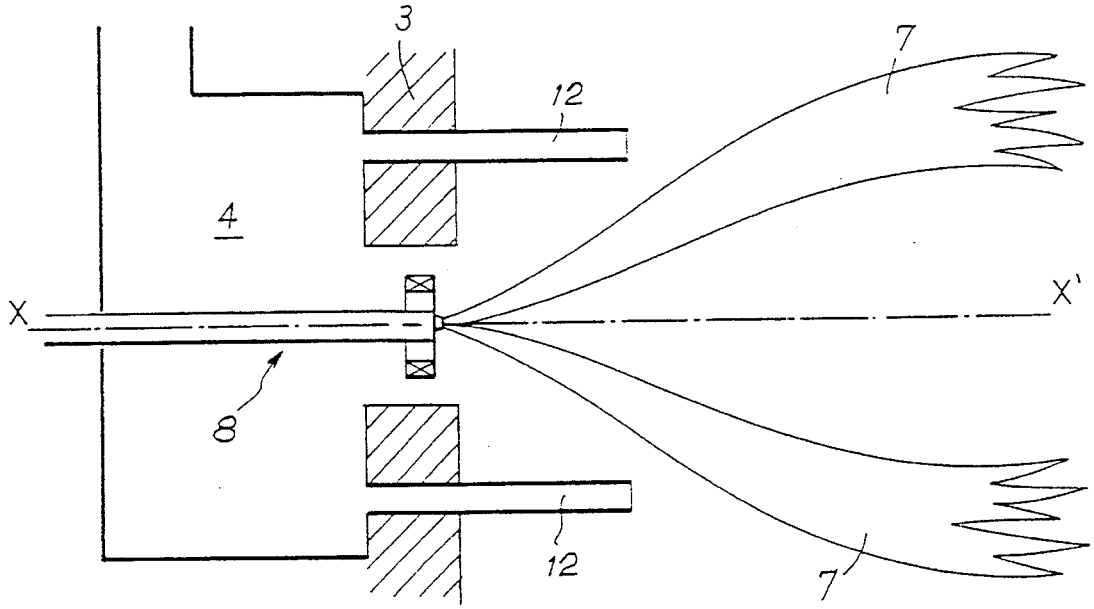
FIG. 3 is a view in section of another type of burner according to the invention.

FIG. 3 shows an embodiment allowing dismantling of the assembly of the burner from the rear of the wall 3 of the boiler whilst, in the case of FIG. 1, due to the peripheral supply conduits 12 of the injectors 15, this is not possible; according to the arrangement of this FIG. 3, the wall 3 must be drilled for the passage of the injection conduits 12.

Figure 4:
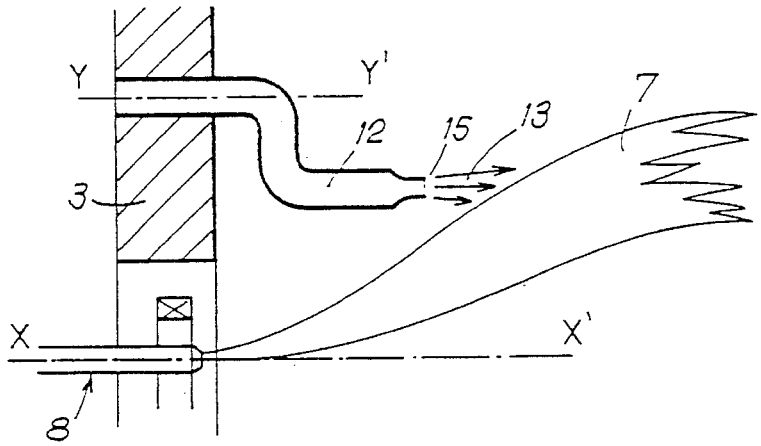
FIG. 4 is a half-view in section of a particular rotary system for injection of secondary air.
Figure 5:
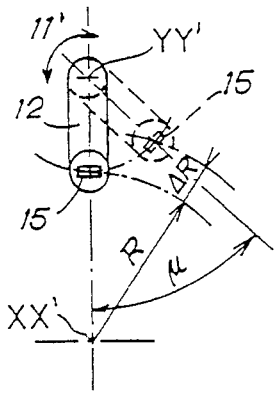
FIG. 5 is a front view of part of the device of FIG. 4.

The embodiment of FIG. 4 is similar to that of FIG. 3, but comprises secondary air supply (12) and injector (15) tubes mounted to pivot and bent with respect to their axis of rotation yy', which may be the axis of drilling of the wall 3 parallel to the principal axis xx' of the burner and so that the radial distance R as shown in FIG. 5 and as described hereinabove, between the corresponding secondary air jet 13 and the axis xx' of the burner is adjustable by a desired distance $\delta R$ as a function of the angle $\mu$ of rotation of the injector: in such an embodiment, it is also necessary to be able to turn all the injection means 8 and the flame stabilizer 5 so as to orient the flames by another angle such that the points of injection 15 are always disposed exactly at the desired places with respect to the elementary flames 7.

Figure 6:
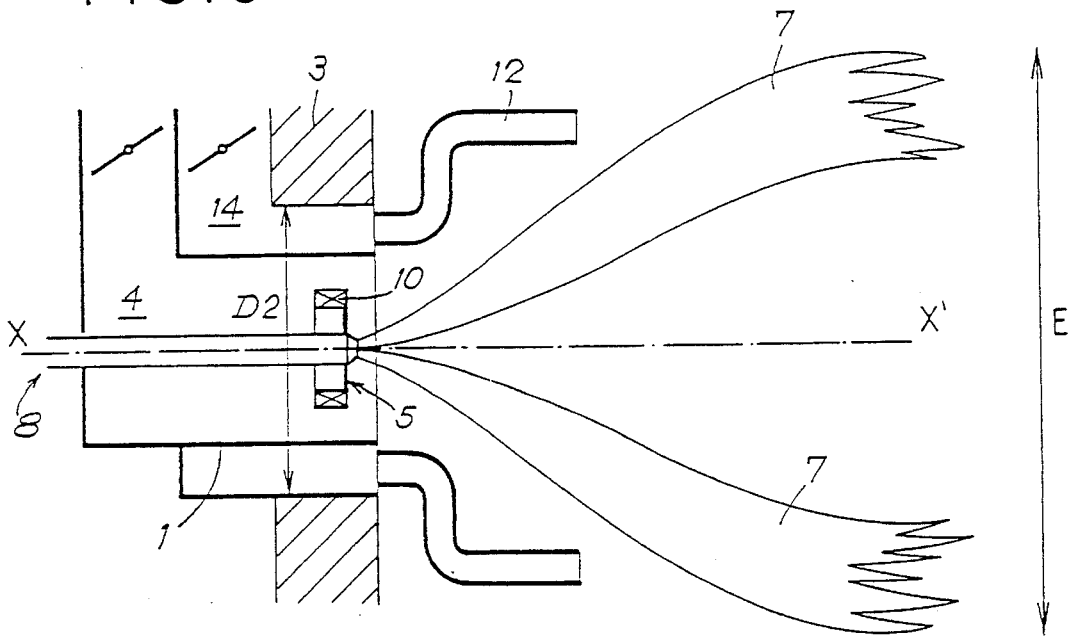
FIGS. 6 and 7 are two other embodiments, viewed in section, of burners according to the invention.

FIG. 6 shows another arrangement which uses a single passage in the wall 3 of the hearth 2, but making it possible to separate the flowrates in the primary air (4) and secondary air (12) circuits, thanks to a supply 14 separate from that of the primary air 4.

In another embodiment according to the same principle of separate supply as that of FIG. 6, the secondary air supply 14 may be to the rear of the primary air supply 4, and the secondary air conduits 12 would traverse the latter longitudinally, passing through the primary air director conduit 1.

In fact, in the other preceding embodiments, the supply pressure .is therefore the same for the primary air and the secondary air, since they arrive via a common circuit 4 which thus ensures virtually equal primary air and secondary air outlet speeds, generally included between 30 and 50 meters per second when the burner is at its nominal flowrate.

Thanks to embodiments of the type shown in FIG. 6 or FIG. 7, the secondary air circuits 12, comprising separate supplies 14, may allow a speed of the air jets 13 at the outlet of the air injectors 15, of 40 to 120 meters per second, viz. different from that of the primary air: this is especially interesting for high speeds for the purpose indicated hereinabove of aerodynamic action on the end of the elementary flames 7 in order to reduce its inclination β with respect to the axis xx' and to reduce the maximum outer diameter E.

Figure 8:
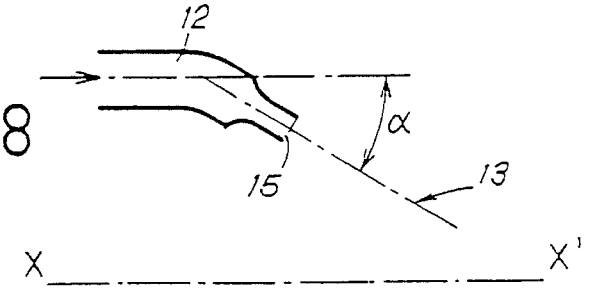
FIG. 8 is an embodiment of particular injectors according to the invention.

This may also be completed by the inclination of the ends of each injector 15 by an angle α included between 0 and 30° towards axis xx' of the burner and with respect to the direction thereof, as shown in FIG. 8.

FIG. 7 shows another burner device according to the present invention, but comprising independent channels $4_1$ and $4_2$ for supplying primary air through, for channel $4_1$, the flame stabilizer 5 and, for channel $4_2$, the peripheral air conduit 6 located concentrically about this stabilizer 5.

In the principal body of any burner according to the invention, as shown by way of example in all FIGS. 1 to 7, and constituting the primary circuit, the primary air flowrate 4 is reduced with respect to a non-stepped burner: the diameter D1 of the body of the burner, as shown for example in FIG. 1, as well as the diameters D and d of the stabilizer 5, as defined previously, must then be reduced in proportion so as to maintain the air outlet speed constant between 30 and 50 meters per second, as mentioned above.

In the case of the embodiments as shown in FIGS. 1 or 6, this then makes it possible to conserve a diameter D2 of bore of the wall 3 of the hearth 2 relatively close to the diameter D1 of a non-stepped burner, and consequently not to require an increase in this bore diameter.

The axial distance L of the end of the secondary air injectors 15 with respect to the end of the fuel injection means 8, 9, the radial distance "R" with respect to the axis xx' of the burner of said ends of air injectors 15, and the inner diameter D1 of the total air supply conduit of the burner are such that:

$$L=(0 \text{ to } 2)\times D1 \text{ and } 2R=(2 \text{ to } 4)\times D1.$$

What is claimed is:

1. A process for reducing nitrous oxides by exploiting a fluid burner having a horizontal axis comprising fuel injection means for injecting one of a liquid and a gaseous fuel into a hearth via multiple orifices, thereby creating a plurality of divergent independent flames having respective flame ends, at least one primary air supply conduit for supplying combustion air to said fuel injection means, said primary air supply conduit having an inner diameter, said diameter defining an extent D1, a central flame stabilizer about said fuel injection means, and at least one secondary air supply conduit located radially outward with respect to the primary air supply conduit, wherein the burner includes a plurality of secondary air supply injectors, there being as many of said secondary injectors as there are said divergent flames, each of said secondary air injectors being displaced an axial distance from the multiple orifices inward of said hearth, said distance defining a length L, so that a like radial distance exists between said burner axis and each respective secondary air injector axis, said radial distance defining an extent R, comprising the steps of:

simultaneously introducing said primary combustion air to said primary air supply conduit and said fuel to said fuel injectors so as to produce individual flames emanating from each respective fuel injector;

introducing combustion air into said secondary air injectors so as to supply a secondary source of air into each of said flames emanating from said fuel injectors;

positioning each of said secondary air injectors so as to precisely add combustion air to each of said flames so as to limit a peak flame temperature and to allow a stepped combustion in order to reduce nitrous oxide emissions.

2. The process of claim 1 wherein the secondary air supplied by said secondary air injectors represents between 20 and 50% of the combustion air supplied in the hearth for combustion.

3. The process of claim 1, further including a secondary air supply that is independent of said primary air supply, said secondary air supply feeding a second and independent source of combustion air to said secondary air injectors.

4. The process of claim 3 wherein the secondary air supply is such that it ensures an air speed at an outlet of the secondary air injector, of between 40 to 120 m/sec.

5. The process of claim 4 wherein said combustion air from said secondary air injectors reduces an angle of inclination of said flames with respect to said burner axis.

6. A fluid fuel burner having a horizontal axis comprising fuel injection means for injecting one of a liquid and a gaseous fuel into a hearth via multiple orifices, thereby creating a plurality of divergent independent flames having respective flame ends, at least one primary air supply conduit for supplying combustion air to said fuel injectors, said primary air supply conduit having an inner diameter, said diameter defining an extent D1, a central flame stabilizer about said fuel injection means, and at least one secondary air supply conduit located radially outward with respect to the primary air supply conduit, wherein the burner includes a plurality of secondary air supply injectors, there being as many of said secondary air injectors as there are said divergent flames, each of said secondary air injectors being displaced an axial distance from the multiple orifices inward of said hearth, said distance defining a length L, so that a like radial distance R exists between said burner axis and each respective secondary injector axis, said radial distance defining an extent R, and each respective secondary air injector furnishes an additional and secondary supply of air to each respective flame after a first phase of combustion occurs between said primary air and said fuel.

7. The fluid fuel burner of claim 6, wherein the secondary air supplied by said secondary air injectors represents between 20 and 50% of the combustion air supplied in the hearth for combustion.

8. The fluid fuel burner of claim 6 wherein the secondary air supplied by said secondary air injectors is about 35% of the combustion air supplied in the hearth for combustion.

9. The fluid fuel burner of claim 6, wherein said secondary air injectors are mounted to pivot and bend with respect to their axis of rotation, so that the radial distance between the corresponding secondary air jet and the horizontal axis of the burner is adjustable as a function of the angle of rotation of the burners.

10. The fluid fuel burner of claim 6, wherein of each of said secondary air injectors has a respective end, each end inclined by an angle between 0 and 30° with respect to and towards the axis of the burner.

11. The fluid fuel burner of claim 6, wherein the number of the fuel injectors and secondary air injectors is between 4 and 7.

12. The fluid fuel burner of claim 6, wherein said central primary flame stabilizer includes a plurality of inclined blades attached about a central hub, said central hub connecting said stabilizer to said fuel injection means, said fuel injection orifices defining respective planes with said burner axis and each of said secondary air injectors being angularly offset with respect to said planes.

13. The fluid fuel burner of claim 6, wherein the axial distance L, the radial distance R, and the inner diameter D1 are such that $$L=[(0\times2)](0 \text{ to } 2)\times D1 \text{ and } 2R=(2 \text{ to } 4)\times D1.$$

14. The fluid fuel burner of claim 6, further including a secondary air supply that is independent of said primary air supply, said secondary air supply feeding a second and independent source of combustion air to said secondary air injectors.

15. The fluid fuel burner of claim 14, wherein the secondary air supply is such that it ensures an air speed at an outlet of the secondary air injectors, of between 40 to 120 m/sec.

16. The fluid fuel burner of claim 6 wherein said secondary air injectors are so disposed that said secondary air is ejected therefrom so as to limit a peak flame temperature of each respective flame and to allow a stepped combustion in order to reduce nitrous oxide emissions.

17. The fluid fuel burner of claim 16 wherein said combustion air from said secondary air injectors reduces an angle of inclination of the flames with respect to said burner axis.

18. The fluid fuel burner of claim 17, further including a secondary air supply that is independent of said primary air supply, said secondary air supply feeding a second and independent source of combustion air to said secondary injectors.

19. The fluid fuel burner of claim 18, wherein the secondary air supply is such that it ensures an air speed at an outlet of the secondary air injector, of between 40 to 120 m/sec.

* * * * *

UNITED STATES PATENT AND TRADEMARK OFFICE

CERTIFICATE OF CORRECTION

PATENT NO. : 5,562,437

DATED : October 8, 1996

INVENTOR(S) : Gauthier, et al

It is certified that error appears in the above-indentified patent and that said Letters Patent is hereby corrected as shown below:

Column 9, Claim 13, line 4,"[(0x2)]" has been deleted from the formula.

Signed and Sealed this

First Day of April, 1997

*Attest:*

*Attesting Officer*

Bruce Lehman

BRUCE LEHMAN

*Commissioner of Patents and Trademarks*

UNITED STATES PATENT AND TRADEMARK OFFICE

CERTIFICATE OF CORRECTION

PATENT NO. : 5,562,437

DATED : October 8, 1996

INVENTOR(S) : Gauthier, Jean-Claude, et al.

It is certified that error appears in the above-identified patent and that said Letters Patent is hereby corrected as shown below:

In Column 8, Claim 9, line 53, the word "burners" has been replaced with

--secondary air injectors--.

Signed and Sealed this

Thirteenth Day of January, 1998

Bruce Lehman

*Attest:*

BRUCE LEHMAN

*Attesting Officer*

*Commissioner of Patents and Trademarks*